US008066064B2

(12) United States Patent
Minassian et al.

(10) Patent No.: US 8,066,064 B2
(45) Date of Patent: Nov. 29, 2011

(54) WELL ASSEMBLY HAVING A CASING HANGER SUPPORTED BY A LOAD MEMBER ACTUATED BY A RETRACTABLE MEMBER DISPOSED IN THE WELLHEAD

(75) Inventors: Marc Minassian, Magnolia, TX (US); David L. Ford, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 216 days.

(21) Appl. No.: 12/269,620

(22) Filed: Nov. 12, 2008

(65) Prior Publication Data

US 2010/0116486 A1 May 13, 2010

(51) Int. Cl.
*E21B 33/04* (2006.01)
*E21B 23/02* (2006.01)

(52) U.S. Cl. ..... 166/89.3; 166/96.1; 166/138; 166/216

(58) Field of Classification Search ..... 166/379, 166/382, 89.3, 88.2, 96.1, 134, 138, 348, 166/368, 216, 208, 217
See application file for complete search history.

(56) References Cited

U.S. PATENT DOCUMENTS 4,139,059 A * 2/1979 Carmichael ..... 166/208
4,421,164 A * 12/1983 Galle, Jr. ..... 166/118
4,569,404 A * 2/1986 Milberger et al. ..... 166/208
4,730,851 A * 3/1988 Watts ..... 285/4
4,836,579 A * 6/1989 Wester et al. ..... 285/3
4,886,121 A * 12/1989 Demny et al. ..... 166/382
4,909,546 A * 3/1990 Nobileau ..... 285/123.4
5,002,131 A * 3/1991 Cromar et al. ..... 166/382
5,127,478 A * 7/1992 Miller ..... 166/348
5,620,052 A * 4/1997 Turner ..... 166/348
6,598,673 B1 7/2003 Hosie et al.
7,025,145 B2 * 4/2006 Emmerson ..... 166/348
7,040,407 B2 * 5/2006 Jennings et al. ..... 166/348
7,134,490 B2 * 11/2006 Nguyen ..... 166/208
7,150,323 B2 12/2006 Ford
7,380,607 B2 6/2008 Thomas
7,441,594 B2 * 10/2008 Vanderford et al. ..... 166/75.14
7,819,182 B2 * 10/2010 Adamek ..... 166/66
2005/0051337 A1 * 3/2005 Jennings et al. ..... 166/348
2005/0167095 A1 * 8/2005 Nguyen ..... 166/88.2
2006/0016604 A1 * 1/2006 Ford ..... 166/348
2010/0116486 A1 * 5/2010 Minassian et al. ..... 166/88.1

* cited by examiner

*Primary Examiner* — Jennifer H Gay
(74) *Attorney, Agent, or Firm* — Bracewell & Giuliani LLP

(57) ABSTRACT

A wellhead system comprising a high pressure housing having a retractable ring and a casing hanger having an activation ring configured to be engaged by the retractable ring when the casing hanger is lowered into the high pressure housing. An expandable load member is carried by the casing hanger into the high pressure housing. When the activation ring is engaged by the retractable ring, the activation ring is blocked from further downward motion. The activation ring and the body of the casing hanger cooperate with the load member to expand the load member outward into engagement with the high pressure housing as the casing hanger is lowered further into the high pressure housing. The outer surface of the load member and the inner surface of the high pressure housing are configured so that the high pressure housing supports the casing hanger when the load member is expanded into engagement with the high pressure housing.

19 Claims, 9 Drawing Sheets

WELL ASSEMBLY HAVING A CASING HANGER SUPPORTED BY A LOAD MEMBER ACTUATED BY A RETRACTABLE MEMBER DISPOSED IN THE WELLHEAD

BACKGROUND

The invention relates generally to wellhead casing assemblies. In particular, the invention relates to a wellhead casing assembly having a casing hanger actuated by a contractible ring disposed in a wellhead housing.

Casing is strong steel pipe that is used in an oil and gas well to ensure a pressure-tight connection from the surface to the oil and/or gas reservoir. Casing serves many purposes in the well. It can protect the wellbore from caving in or being washed out. It can also confine production to the wellbore; so that water does not intrude into the wellbore or drilling mud intrude into the surrounding formations. It can also provide an anchor for the components of the well. Production tubing, such as coiled tubing, typically is used to transport oil to the surface.

Several sections of casing joined together end-to-end are known as a "casing string." Because casing serves several different purposes, it is typical to install more than casing string in a well. Casing strings typically are run in a concentric arrangement with each inner casing string extending progressively deeper into the ground. For example, typically, the outermost casing string extends to the shallowest depth in the ground and the innermost casing string extends to the deepest depth.

A casing hanger is a device that is used to support a casing string from a wellhead housing or other structure within the well. In addition, the casing hanger serves to ensure that the casing is properly located in the well. When the casing string has been run into the wellbore, the casing string is hung, or suspended, in the well by the casing hanger. Multiple casing hangers may supported by the wellhead housing.

Typically, the casing hanger rests on a landing shoulder inside the wellhead housing. In one type of wellhead housing, the load shoulder is permanently formed in the bore during manufacturing. This permanent load shoulder reduces the effective diameter for objects that are desired to be inserted in the wellbore below the casing hanger. For example, it may be desired to suspend one or more casing hangers from casing below the wellhead housing. In some instances, it may be desired that the casing hangers suspended below the wellhead housing take advantage of the full bore of the casing below the wellhead housing for the entire length of the bore.

A number of techniques have been developed to enable full bore access to components below the wellhead housing. However, these techniques typically use complicated load ring systems to support the casing hanger within the wellhead housing.

Therefore, an improved technique for supporting casing with a wellhead is desired. In particular, an improved technique for supporting a casing hanger in a wellhead while providing full bore access below the wellhead is desired.

BRIEF DESCRIPTION

A wellhead system comprising a high pressure housing having a retractable ring and a casing hanger having an activation ring configured to be engaged by the retractable ring when the casing hanger is lowered into the high pressure housing. An expandable load member is carried by the casing hanger into the high pressure housing. The load member may be an expandable ring, a dog, or some other similar load bearing device. When the activation ring is engaged by the retractable ring, the activation ring is blocked from further downward motion. The activation ring and the body of the casing hanger cooperate with the load member to urge the load member outward into engagement with the high pressure housing as the casing hanger is lowered further into the high pressure housing. The outer surface of the load member and the inner surface of the high pressure housing are configured so that the high pressure housing supports the casing hanger when the load member is engaged with the high pressure housing.

The activation ring may also comprise a cantilever arm having a tooth disposed proximate to the end of the cantilever arm. The tooth is adapted to cooperate with a tooth on the casing hanger to enable an over-pull test of the casing hanger to be performed. An over-pull test is a test performed to ensure that the casing hanger is secured in the wellhead housing. Initially, the tooth of the activation ring is disposed below the tooth on the casing hanger. However, as the casing hanger is lowered in the wellhead relative to the activation ring, the cantilever arm is deflected to enable the tooth of the activation ring to pass by the tooth on the casing hanger and be relocated above the tooth on the casing hanger. During the over-pull test, an upward force is applied to the casing hanger. Because the tooth of the activation ring is located above the tooth of the hollow body of the casing hanger, the casing hanger tooth urges the activation ring tooth and, thus, the load ring upward. If the load ring is engaged with the wellhead housing, the load ring will oppose the upward force. This opposition will be detected at the surface, indicating that the load ring is set in the high pressure housing.

DRAWINGS

These and other features, aspects, and advantages of the present invention will become better understood when the following detailed description is read with reference to the accompanying drawings in which like characters represent like parts throughout the drawings, wherein:

FIG. 5 is a cross-sectional elevation view of the casing hanger being lowered into the wellhead housing from a location above the wellhead housing, in accordance with an exemplary embodiment of the present technique;

FIG. 6 is a cross-sectional elevation view of the casing hanger being lowered into the wellhead housing with an activation ring being of the casing hanger being engaged by a C-ring of the wellhead housing, in accordance with an exemplary embodiment of the present technique;

FIG. 7 is a cross-sectional elevation view of the casing hanger being lowered into the wellhead housing with a tooth of a cantilever arm of the activation ring being located above a corresponding tooth of the hollow body of the casing hanger, in accordance with an exemplary embodiment of the present technique;

Figure 8:
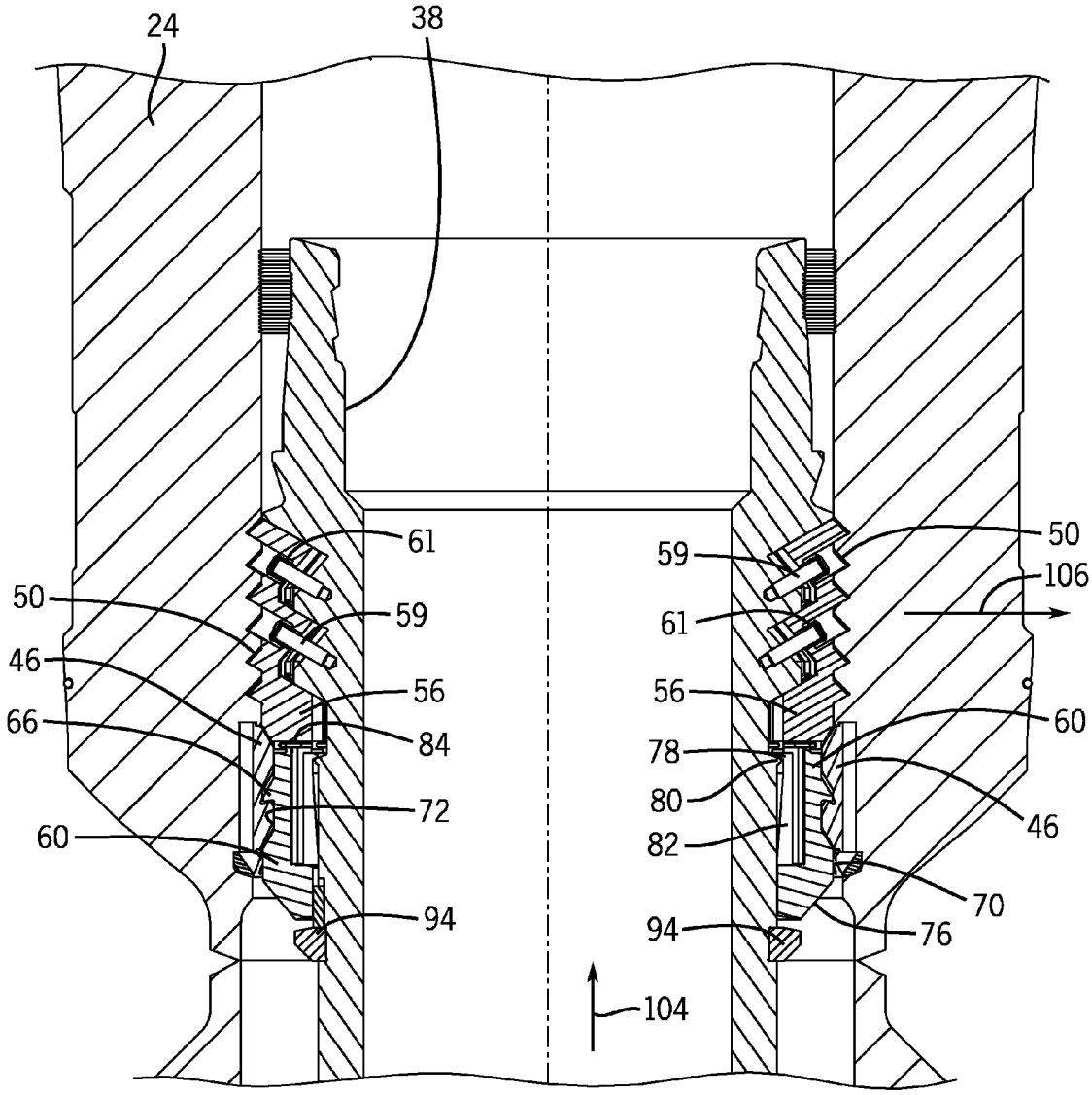
Figure 9:
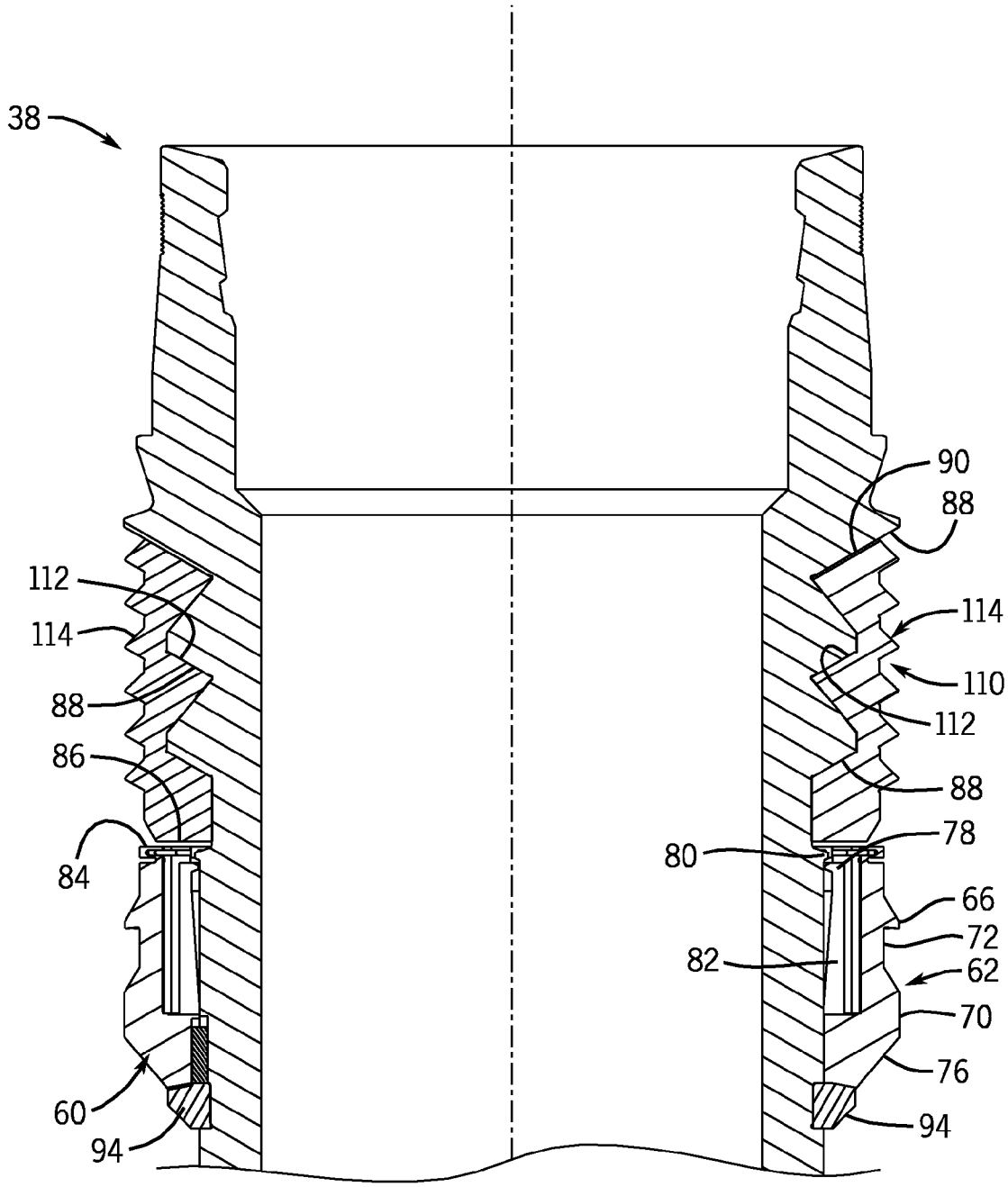

FIG. 8 is a cross-sectional elevation view of the casing hanger secured within the wellhead housing by a load ring of the casing hanger expanded into engagement with an inner surface profile of the wellhead housing by the activation ring, in accordance with an exemplary embodiment of the present technique; and FIG. 9 is a cross-sectional view of an alternative embodiment of a casing hanger assembly, in accordance with an exemplary embodiment of the present technique.

DETAILED DESCRIPTION

Figure 1:
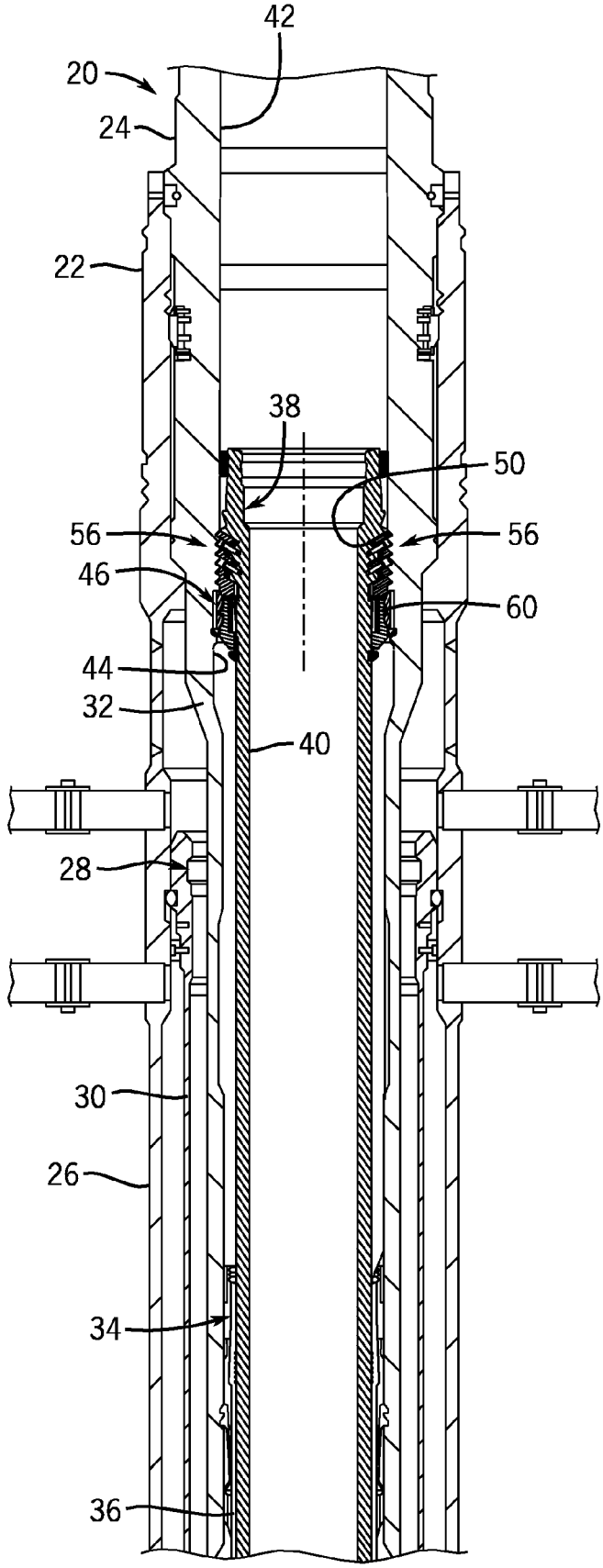
FIG. 1 is a cross-sectional view of a wellhead casing assembly, in accordance with an exemplary embodiment of the present technique.
Figure 2:
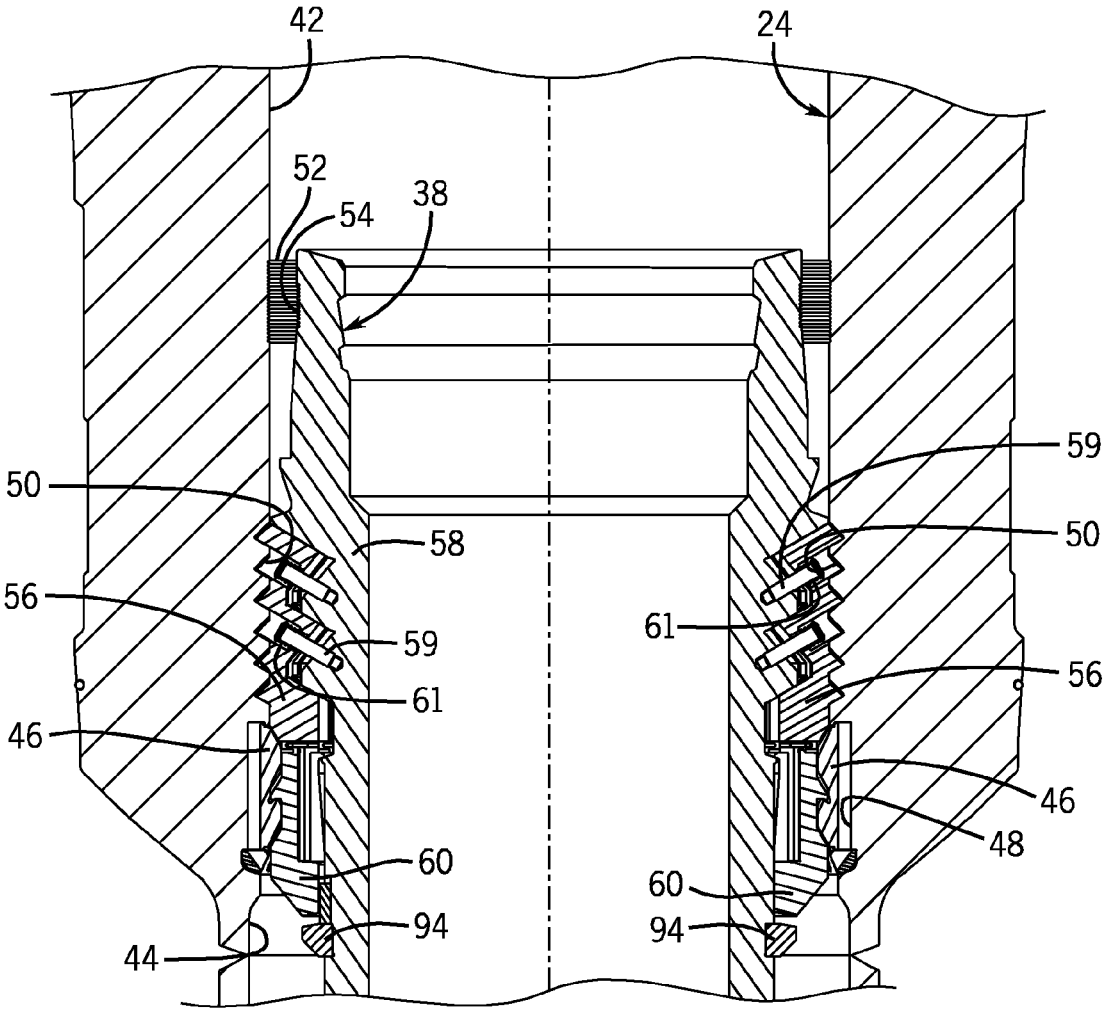
FIG. 2 is a detailed view of a casing hanger supported by a wellhead housing, in accordance with an exemplary embodiment of the present technique.

Referring now to FIG. 1, the present invention will be described as it might be applied in conjunction with an exemplary technique, in this case a well assembly for directing oil and/or gas from a well to transmission pipelines or a storage facility, as represented generally by reference numeral 20.

The wellhead assembly 20 comprises a low pressure housing 22 and a high pressure housing 24 connected to the low pressure housing 22. The low pressure housing 22 is connected to and supported by an outer casing string, or conductor pipe, 26 that is secured to the ground. In the illustrated embodiment, the low pressure housing 22 supports a first casing hanger 28 that, in turn, is connected to and supports a first inner casing string 30. The first casing hanger 28 and first inner casing string 30 are inserted into the outer casing string 26 before the high pressure housing 24 is secured to the low pressure housing 22. In the illustrated embodiment, the high pressure housing 24 supports a high pressure housing casing string 32. The high pressure housing casing string 32, in turn, supports a second casing hanger 34 and a second casing hanger casing string 36.

Referring generally to FIGS. 1-4, the high pressure housing 24 is used to support a high pressure housing casing hanger 38 and a high pressure housing casing hanger casing string 40. The high pressure housing 24 is a fullbore housing in that it does not have any restrictions that might block the passage of objects through the high pressure housing 24. Thus, objects having a width almost as great as the entry bore 42 of the high pressure housing 24 can pass through the high pressure housing 24 to an exit bore 44 of the high pressure housing 24. For example, the illustrated embodiment of the high pressure housing 24 does not have any load shoulders machined into the high pressure housing 24 to form a landing for a casing hanger. Such a load shoulder would restrict the diameter of objects that could be passed through the high pressure housing 24 to the exit bore 44 of the high pressure housing 24.

Figure 3:
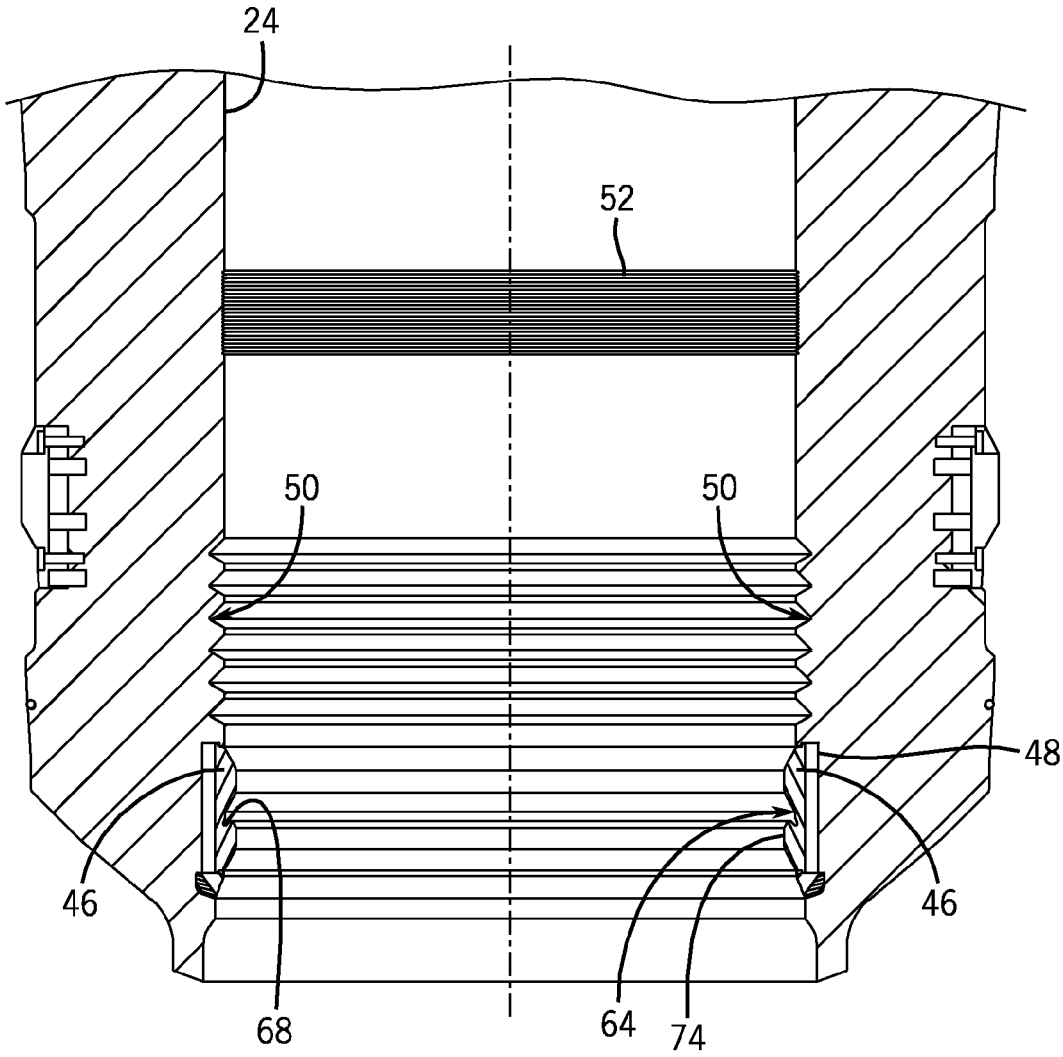
FIG. 3 is a cross-sectional elevation view of a wellhead housing, in accordance with an exemplary embodiment of the present technique.
Figure 4:
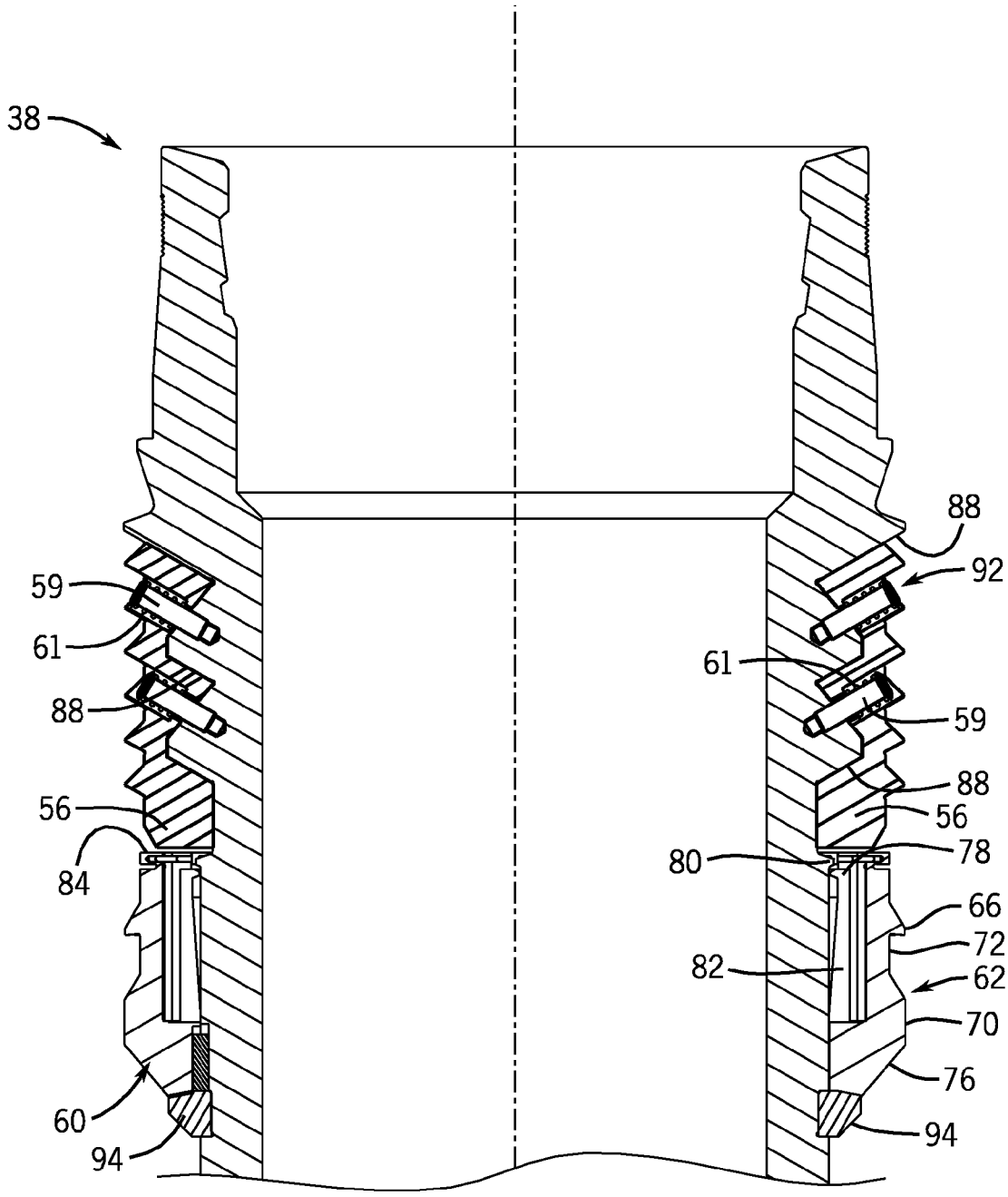
FIG. 4 is a cross-sectional elevation view of a casing hanger, in accordance with an exemplary embodiment of the present technique.

As best illustrated in FIG. 3, the illustrated embodiment of the high pressure housing 24 comprises a contractible and expandable split "C-ring" 46 that is disposed within a recess 48 in the high pressure housing 24. In addition, the high pressure housing 24 has an inner surface profile 50. The C-ring 46 and the inner surface profile 50 are configured to cooperate with the high pressure housing casing hanger 38 to support the high pressure housing casing hanger 38 within the high pressure housing 24. In the illustrated embodiment, the C-ring 46 is biased inward so that a portion of the C-ring 46 extends into the bore 42 of the high pressure housing 24. However, the recess 48 has sufficient depth to enable the C-ring 46 to be expanded into the recess 48 so that the C-ring 46 does not obstruct passage through the high pressure housing 24. In addition, in this embodiment, the inner surface profile 50 is a toothed profile formed in the high pressure housing 24. Because there is no load shoulder formed in the high pressure housing 24 to support the high pressure housing casing hanger 38, the second casing hanger 34 may have a diameter almost as great as the entry bore 42. The diameter of the second casing hanger 34 just needs to be slightly smaller than the diameter of the entry bore 42 of the high pressure housing 24 so that there is sufficient clearance for the casing hanger 38 to be disposed within the high pressure housing 24.

Referring again generally to FIGS. 1-4, the high pressure housing 24 and the high pressure housing casing hanger 38 have wickers 52, 54, respectively, that are used in cooperation with a casing hanger annulus seal (not shown) to form a seal and secure the casing hanger seal within the high pressure housing 24. The seal is disposed in the annulus between the high pressure housing 24 and the high pressure housing casing hanger 38. A portion of the seal is then expanded outward into engagement with the wickers 52 on the high pressure housing 24 on one side and the wickers 54 of the high pressure housing casing hanger 38 on the other side. This engagement both seals the annulus and secures the seal in the high pressure housing 24.

In the illustrated embodiment, the high pressure housing casing hanger 38 has a plurality of "dogs" 56 that may be driven outward from the main body 58 of the casing hanger 38 to engage the inner surface profile 50 of the high pressure housing 24 and serve as load members to enable the high pressure housing 24 to support the high pressure housing casing hanger 38. However, other types of load members may be used, such as a C-ring. In this embodiment, the dogs 56 are secured to the main body 58 of the casing hanger by bolts 59 and springs 61. Each bolt 59 is threaded into the main body 58 of the casing hanger 38 through a channel in the dogs 56. A spring 61 surrounds each bolt 59 and is captured in the channel between the head of the bolt 59 and the main body 58 the casing hanger 38. When the dogs 56 are driven outward, the springs 61 are compressed. The compression of the springs 61 produces a restoring force that urges the dogs 56 to return to a retracted position against the main body 58 of the casing hanger 38.

In addition, in this embodiment, the high pressure housing casing hanger 38 has an activation ring 60 that is used to trigger the process of expanding the dogs 56 into engagement with the high pressure housing 24. However, a non-ring device may be used as an activation member to trigger the process of driving the dogs 56 outward into engagement with the high pressure housing 24. As will be discussed in more detail below, the activation ring 60 cooperates with the dogs 56 and the hollow body 58 of the high pressure housing casing hanger 38 to drive the dogs 56 outward so that the dogs 56 engage the inner profile surface 50 of the high pressure housing 24. The high pressure housing casing hanger 38 is supported by the engagement of the dogs 56 with the inner surface profile 50 of the high pressure housing 24.

The activation ring 60 and the C-ring 46 serve as a lock and key to ensure that the dogs 56 are driven outward only when the high pressure housing casing hanger 38 is at the proper position in the high pressure housing 24, such that the dogs 56 are expanded into engagement with the inner surface profile 50 of the high pressure housing 24. The activation ring 60 has an outer profile 62 that is adapted to engage a corresponding inner profile 64 of the C-ring 46 of the high pressure housing 24 when the high pressure housing casing hanger 38 is at the proper location within the high pressure housing 24. The outer profile 62 of the illustrated embodiment of the activation ring 60 has a male hook ring 66 that is caught by a corresponding female hook ring 68 formed in the C-ring 46. The outer profile 62 of the activation ring 60 also comprises a protruding portion 70 and a recessed portion 72 that is adapted to receive a corresponding protruding portion 74 of the C-ring 46. The engagement of the protruding portion 70 and the recessed portion 72 of the activation ring 60 with the protruding portion 74 of the C-ring 46 ensures that the male hook ring 66 is engaged only by the female hook ring 68 of the C-ring 46 and is not engaged inadvertently by another component of the system. The protruding portion 70 of the activation ring 60 also has a tapered bottom surface 76 that prevents the activation ring 60 from being inadvertently snagged by a surface feature in the high pressure housing 24.

During installation of the high pressure housing casing hanger 38 in the high pressure housing 24, downward movement of the activation ring 60 is blocked by engagement with the C-ring 46. However, the hollow body 58 of the high pressure housing casing hanger 38 may still be lowered further into the high pressure housing 24. The high pressure casing hanger 38 has a first over-pull tooth 78 and the activation ring 60 has a second over-pull tooth 80 located at the end of a cantilever arm 82. As will be discussed in more detail below, the first and second over-pull teeth 78, 80 provide an indication when the dogs 56 have been activated, as well as being used during an over-pull test to ensure that the dogs 56 are engaged with the inner surface profile 50 of the high pressure housing 24. As the high pressure housing casing hanger 38 is lowered further into the high pressure housing 24, the first over-pull tooth 78 engages the second over-pull tooth 80. This causes a portion of the weight of the casing hanger 38 to be transferred to the C-ring 46 through the engagement of the teeth 78, 80. This may be seen on the surface as a sudden reduction in weight on the string. As more weight is transferred to the teeth 78, 80, the increase in weight on the teeth 78, 80 causes the cantilever arm 82 to deflect outward quickly, or "snap." This is reflected as a sudden increase in weight on the string at the surface as the activation ring 60 is no longer transferring load to the C-ring 46. This deflection of the cantilever arm 82 allows the main body 58 of the casing hanger to move downward relative to the activation ring 60. In addition, the second over-pull tooth 80 is now positioned over the first over-pull tooth 78. This new orientation of the first and second over-pull teeth will play a role during the over-pull test. However, rather than the cantilever arm 82 and the teeth 78, 80, a C-ring may be used to enable an over-pull test.

As the high pressure housing casing hanger 38 is lowered still further into the high pressure housing 24, a bottom surface 86 of the dogs 56 abuts a spring surface 84 atop the activation ring 60, blocking further downward movement of the dogs 56. The spring surface 84 is adapted to shift load smoothly from the activation ring 60 to the dogs 56 so that the activation ring 60 does not assume a large portion of the weight of the casing hanger 38. Additional downward movement of the high pressure housing casing hanger 38 causes the hollow body 58 of the high pressure housing casing hanger 38 to apply an outward force on the dogs 56.

The high pressure housing casing hanger 38 has tapered surfaces 88 and the dogs 56 have corresponding tapered surfaces 90 that cooperate to expand the dogs 56 outward as the hollow body 58 of the high pressure housing casing hanger 38 is urged against the dogs 56. The dogs 56 have a corresponding outer surface profile 92 that engages the inner surface profile 50 of the high pressure housing 24, securing the high pressure housing casing hanger 38 to the high pressure housing 24. In the illustrated embodiment, the inner surface profile 50 of the high pressure housing 24 and the outer surface profile 92 of the dogs 56 are toothed profiles. In addition, the high pressure housing casing hanger 38 has a stop ring 94 that maintains the activation ring 60 in a desired position on the hollow body 58 of the high pressure housing casing hanger 38 during the installation process.

Figure 5:
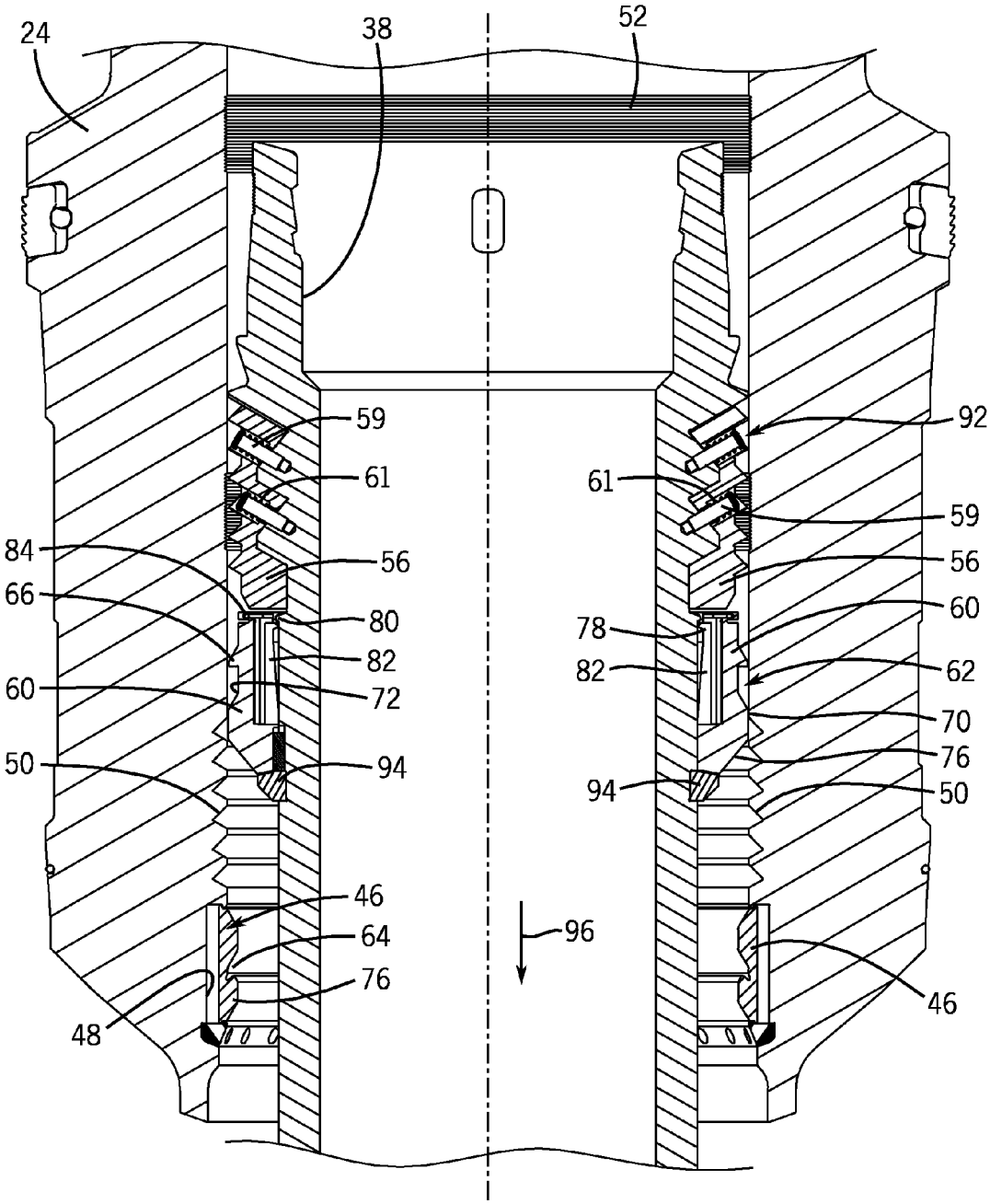
FIGS. 5-8 are a series of cross-sectional elevation views illustrating the sequence of installing the casing hanger in the wellhead housing, in accordance with an exemplary embodiment of the present technique.

Referring generally to FIG. 5, a casing hanger setting tool (not shown) is used to lower the high pressure housing casing hanger 38 into the high pressure housing 24, as represented generally by reference numeral 96.

Figure 6:
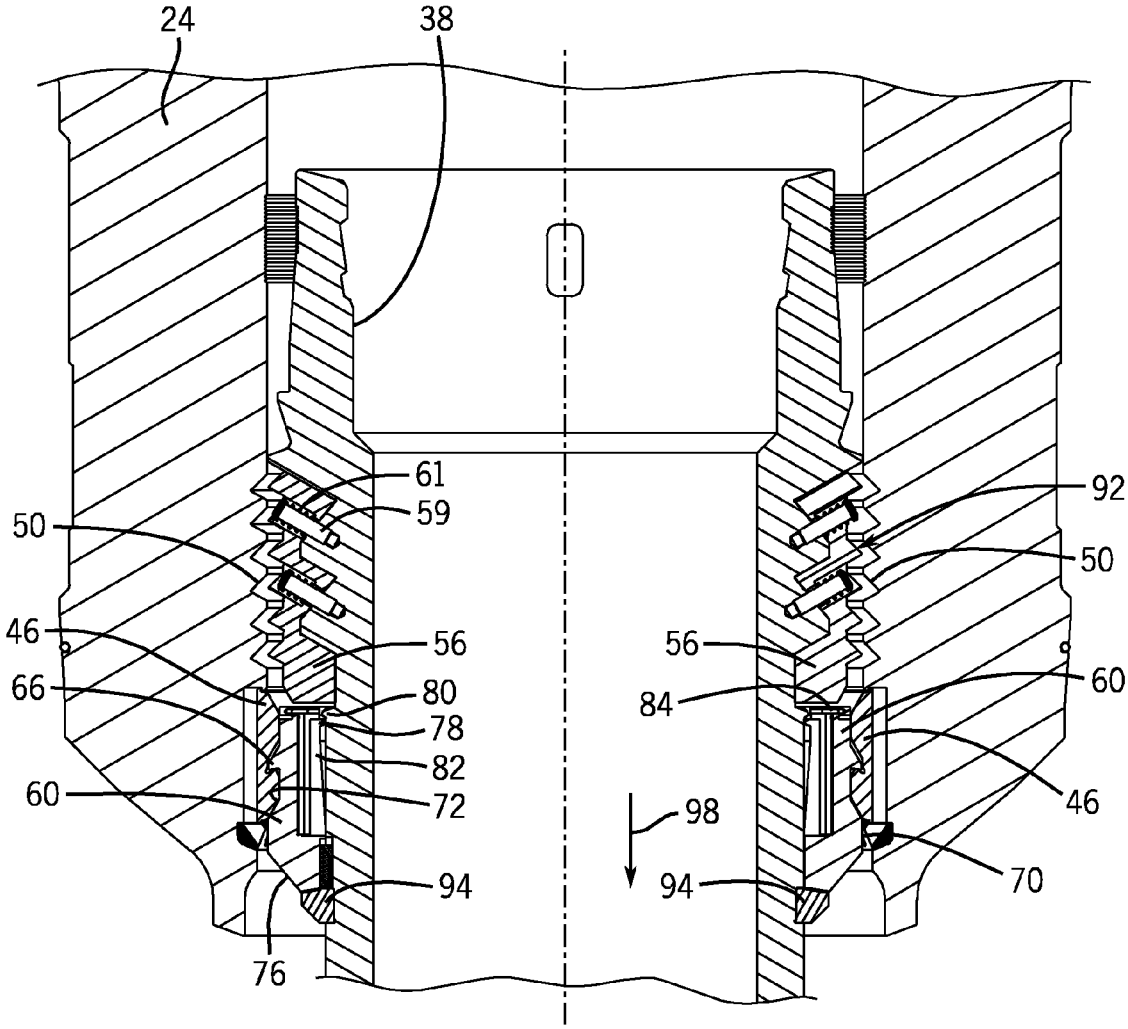

Referring generally to FIG. 6, eventually, as the high pressure housing casing hanger 38 is lowered still further into the housing 24, as represented generally by reference numeral 98, the activation ring 60 is engaged by the C-ring 46. This engagement stops further downward movement of the activation ring 60.

Figure 7:
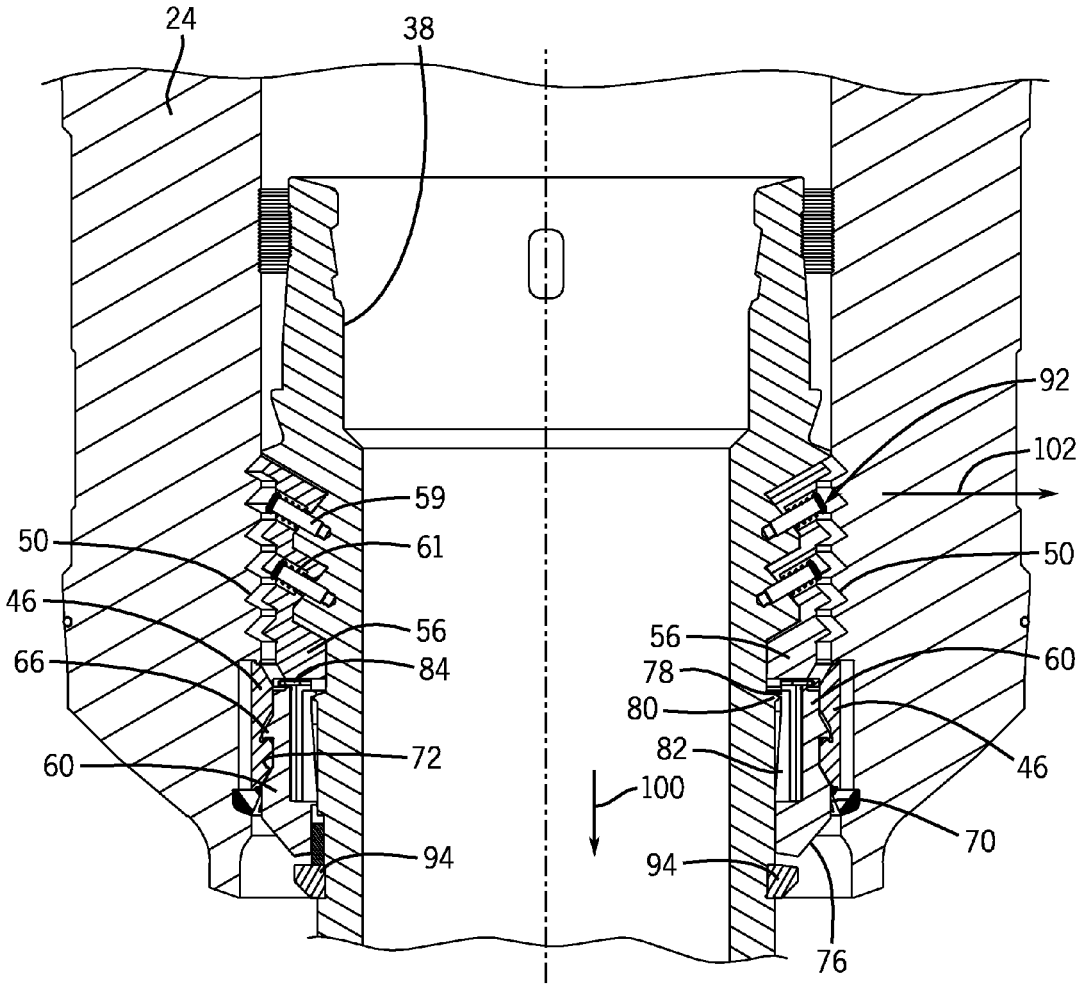

Referring generally to FIG. 7, as the high pressure housing casing hanger 38 is lowered still further into the high pressure housing 24, as represented generally by reference numeral 100, engagement between the first over-pull tooth 78 and the second over-pull tooth 80 causes the cantilever arm 82 to deflect outward and then inward, as the second over-pull tooth 80 clears the first over-pull tooth 78. In addition, if there was a gap between the dogs 56 and the activation ring 60, the bottom surface 86 of the dogs 56 are now abutted against the spring surface 84 of the activation ring 60. This causes the activation ring 60 to block further downward motion of the dogs 56. Because downward movement of the dogs 56 is blocked by the activation ring 60, the tapered surfaces 88 of the casing hanger 38 and the tapered surfaces 90 of the dogs 56 produce a mechanical advantage that urges the dogs 56 outward, as represented by arrow 102, as the casing hanger 38 is lowered.

Referring generally to FIG. 8, additional downward movement of the casing hanger 38 causes the dogs 56 to be driven outward so that the outer surface profile 92 of the dogs 56 engages the inner surface profile 50 of the high pressure housing 24, supporting the casing hanger 38 in the housing 24. As noted above, the springs 61 within the dogs 56 are compressed when the dogs 56 are driven outward. This produces a spring force that urges the dogs 56 to a retracted position. However, the weight of the casing and the tapered surfaces 88, 90 of the dogs 56 and the casing hanger 38 produce a greater force than the spring force that drives the dogs 56 outward.

An over-pull test may then be performed to verify that the high pressure housing casing hanger 38 is set in the high pressure housing 24. A lifting force, as represented by arrow 104, is applied to the high pressure housing casing hanger 38 by the setting tool (not shown). The lifting force 104 is transmitted to the first protrusion 78, which then transmits the force to the activation ring 60 via the second protrusion 80. The lifting force 104 applied to the activation ring 60, in turn, is transmitted to the dogs 56. This urges the tapered surfaces 90 of the dogs 56 against the tapered surfaces 88 of the casing hanger 38. This, in turn, urges the dogs 56 outward into engagement with the high pressure housing 24, as represented by arrow 106. If the outer surface profiles 92 of the dogs 56 are engaged with the inner surface profile 50 of the high pressure housing 24, the lifting force 104 will not pull the high pressure housing casing hanger 38 from the high pressure housing 24 and the resistance will be detected at the surface. However, if the outer surface profiles 92 of the dogs 56 do not engage the inner surface profile 50 of the high pressure housing 24, the lifting force 104 will pull the high pressure housing casing hanger 38 from the high pressure housing 24 and the lack of resistance will be detected at the surface.

If it is desired to remove the casing hanger 38, a lifting force having sufficient force may be applied to the casing hanger 38 to cause the second protrusion 78 to deflect the first protrusion 78. This enables the activation ring 62 to lower relative to the main body 58 and allows the load members 56 to retract. With the load members 58 retracted, the casing hanger 38 may be raised from the well.

Referring generally to FIG. 9, an alternative embodiment of a casing hanger assembly is presented. In this embodiment, a C-ring 110 is used as a load member, rather than the dogs 56, to enable the casing hanger 38 to be supported by the wellhead 24. In this embodiment, the C-ring 112 is a split ring that is biased inward. The C-ring 110 has tapered surfaces 112 that cooperate with the tapered surfaces 88 of the casing hanger 38 to drive the C-ring 110 outward when there is downward movement of the casing hanger 38 relative to the C-ring 110. In addition, the C-ring 110 also has an outer surface profile 114 configured to engage the inner surface profile of the high pressure wellhead 24 once the C-ring 110 has been expanded.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A wellhead assembly, comprising:

a wellhead housing having an inner surface profile and a retractable member disposed within the wellhead housing; and a casing hanger, comprising:

a hollow body;

an activation member; and a load member adapted to support the casing hanger by being driven outward into engagement with the inner surface profile of the wellhead housing, wherein a process for driving the load member outward is triggered by engagement of the activation member with the retractable member, wherein the casing hanger and the activation ring are adapted so that the casing hanger applies an upward force on the activation member as a lifting force is applied to the casing hanger after the load member is driven outward into engagement with the inner surface profile of the wellhead housing, and wherein the casing hanger comprises a first protrusion and the activation member comprises a second protrusion disposed on a cantilever arm, wherein the first protrusion is oriented above the second protrusion when the casing hanger is disposed initially into the wellhead, further wherein the cantilever arm deflects to enable the second protrusion to pass by the first protrusion as the casing hanger is lowered into the wellhead after downward movement of the activation member is blocked by the retractable member.

2. The wellhead assembly as recited in claim 1, wherein downward movement of the load member is obstructed by engagement with the activation member after downward movement of the activation member is obstructed by engagement with the retractable member.

3. The wellhead assembly as recited in claim 2, wherein the hollow body and load member are configured so that the load member is urged outward by engagement with the hollow body as the hollow body is lowered and downward movement of the load member is obstructed.

4. The wellhead assembly as recited in claim 1, wherein the inner surface profile of the wellhead housing comprises a first toothed profile and an outer surface profile of the load member comprises a second toothed profile, the first toothed profile receiving the second toothed profile when the load member is driven outward into engagement with the inner surface profile.

5. The wellhead assembly as recited in claim 1, wherein the hollow body and load member are configured so that the load member is urged outward by engagement with the hollow body when there is downward movement of the hollow body relative to the load member.

6. The wellhead assembly as recited in claim 5, wherein the hollow body comprises a first tapered surface and the load member comprises a second tapered surface, the first tapered surface and second tapered surface being configured to cooperate to urge the load member outward when there is downward movement of the hollow body relative to the load member.

7. The wellhead assembly as recited in claim 1, wherein the casing hanger and the activation ring are adapted so that the casing hanger applies an upward force on the activation member as a lifting force is applied to the casing hanger after the load member is driven outward into engagement with the inner surface profile of the wellhead housing.

8. The wellhead assembly as recited in claim 1, wherein the retractable ring and the recess in the wellhead housing are configured to enable the retractable ring to be fully received into the wellhead housing.

9. The wellhead assembly as recited in claim 1, wherein the wellhead housing is a fullbore wellhead housing.

10. A wellhead assembly, comprising:

a wellhead housing comprising an inner surface profile, a recess and a retractable member disposed in the recess; and a casing hanger disposable into the wellhead housing, comprising:

a body having a bore extending therethrough;

an activation member, wherein the retractable member and the activation member are adapted to enable the retractable member to engage the activation member; and a load member disposed on an outer portion of the body and having an outer surface profile adapted to engage the inner surface profile of the wellhead housing, wherein movement of the load member relative to the body is initiated by the engagement of the activation member and the retractable member, wherein the body of the casing hanger and the activation member are adapted to enable the casing hanger to apply an upward force on the activation member when a lifting force is applied to the casing hanger after the load member is urged outward into engagement with the inner surface profile of the wellhead housing, wherein the body of the casing hanger comprises a first protrusion and the activation ring comprises a second protrusion disposed on a cantilever arm, wherein the first protrusion is oriented above the second protrusion when the casing hanger is disposed initially into the wellhead, further wherein the cantilever arm deflects to enable the second protrusion to pass by the first protrusion as the body of the casing hanger is lowered through the wellhead after downward movement of the activation member is blocked by the retractable member.

11. The wellhead assembly as recited in claim 10, wherein the activation member is adapted to block downward movement of the load member after downward movement of the activation member is blocked by the retractable member.

12. The wellhead assembly as recited in claim 11, wherein the body and the load member are configured with corresponding tapered surfaces that cooperate to urge the load member outward when downward movement of the load member is blocked by the activation member and a downward force is applied to the casing hanger and the casing hanger engages the load ring.

13. The wellhead assembly as recited in claim 10, wherein the body of the casing hanger and the activation member are adapted to enable the casing hanger to apply an upward force on the activation member when a lifting force is applied to the casing hanger after the load member is urged outward into engagement with the inner surface profile of the wellhead housing.

14. The wellhead assembly as recited in claim 10, wherein the wellhead housing is a fullbore wellhead housing.

15. A wellhead assembly, comprising:

a wellhead housing having a bore extending therethough, comprising:

a movable member adapted to extend into the bore and retract out of the bore into a recess in the wellhead housing; and a casing hanger, comprising:

a hollow body;

an activation member adapted to engage the movable member as the casing hanger is lowered into the wellhead housing, wherein downward movement of the activation member is blocked by engagement of the activation member with the movable member of the wellhead housing; and a load member having an inner surface portion, wherein the activation member is adapted to block downward movement of the load member after downward movement of the activation member is blocked by engagement with the movable member, and wherein the hollow body and load member are configured to engage each other and to cooperate to urge the load member outward into engagement with the wellhead housing as the hollow body of the casing hanger is lowered and downward movement of the load member is blocked by the activation member wherein the hollow body comprises an outer protrusion and the activation member comprises an inner protrusion disposed on a cantilever arm, wherein the outer protrusion is oriented above the inner protrusion when the casing hanger is disposed initially into the wellhead, further wherein the cantilever arm deflects to enable the inner protrusion to pass by the outer protrusion as the hollow body of the casing hanger is lowered into the wellhead after downward movement of the activation ring is blocked by the retractable member.

16. The wellhead assembly as recited in claim 15, wherein the hollow body has a tapered outer surface and the load member has a tapered inner surface opposite the tapered outer surface of the hollow body.

17. The wellhead assembly as recited in claim 15, wherein the load member has a toothed outer surface and the wellhead housing has a toothed inner surface configured to receive the toothed outer surface of the load member.

18. The wellhead assembly as recited in claim 15, wherein the wellhead housing is a fullbore wellhead housing.

19. A casing hanger, comprising:

a hollow body;

an activation member adapted to engage a portion of a wellhead housing as the casing hanger is lowered into the wellhead housing, wherein; and a load member, wherein the activation member is adapted to block downward movement of the load member after downward movement of the activation member is blocked, and wherein the hollow body of the casing hanger and the load member are configured so that the load member is urged outward into engagement with the wellhead housing by engagement with the hollow body of the casing hanger as the hollow body of the casing hanger is lowered and downward movement of the load member is blocked by the activation member, wherein the activation member comprises a cantilever arm to enable an overpull test of the engagement of the load ring with the casing hanger, the casing hanger comprising a first protrusion and the cantilever arm comprising a second protrusion, wherein the first protrusion is oriented above the second protrusion when the casing hanger is disposed initially into the wellhead, further wherein the cantilever arm is adapted to deflect to enable the second protrusion to pass by the first protrusion as the casing hanger is lowered into the wellhead when downward movement of the activation member is blocked, whereupon an upward force applied to the casing hanger is transmitted to the load ring via the first protrusion of the casing hanger and the second protrusion of the cantilever arm of the activation member.

* * * * *